US005751201A

United States Patent [19]

Pavio

[11] Patent Number: 5,751,201

[45] Date of Patent: May 12, 1998

[54] RESONATOR WITH METAL LAYERS DEVOID OF DC CONNECTION AND SEMICONDUCTOR DEVICE IN SUBSTRATE

[75] Inventor: Anthony M. Pavio, Paradise Valley, Ariz.

[73] Assignee: Motorola, Inc., Schaumburg, Ill.

[21] Appl. No.: 666,183

[22] Filed: Jun. 19, 1996

[51] Int. Cl.[6] ..... H01P 7/00

[52] U.S. Cl. ..... 333/219; 333/246; 333/247

[58] Field of Search ..... 333/202, 204, 333/205, 219, 235, 238, 246, 247; 343/700 MS

[56] References Cited

U.S. PATENT DOCUMENTS

| | | | |
|---|---|---|---|
| 4,477,813 | 10/1984 | Weiss | 343/700 MS |
| 5,008,639 | 4/1991 | Pavio | 333/116 |
| 5,025,232 | 6/1991 | Pavio | 333/26 |
| 5,202,752 | 4/1993 | Honjo | 333/246 X |
| 5,309,122 | 5/1994 | Cox et al. | 333/246 X |
| 5,367,308 | 11/1994 | Weber | 343/700 MS |
| 5,675,295 | 10/1997 | Brebels et al. | 331/105 |

FOREIGN PATENT DOCUMENTS

| | | | |
|---|---|---|---|
| 406291527 A | 10/1994 | Japan | 333/219 |
| 1062809 | 12/1983 | U.S.S.R. | 333/219 |
| 2 046 530 | 11/1980 | United Kingdom . | |

*Primary Examiner*—Robert Pascal
*Assistant Examiner*—Barbara Summons
*Attorney, Agent, or Firm*—George C. Chen

[57] ABSTRACT

A resonator includes a substrate (15) having a first dielectric constant, an insulative layer (16, 31) overlying the substrate (15) and having a second dielectric constant wherein the second dielectric constant is lower than the first dielectric constant, and a electrically conductive layer (11) overlying the insulative layer (16, 31). The resonator has a higher "Q" factor than the prior art.

10 Claims, 2 Drawing Sheets

RESONATOR WITH METAL LAYERS DEVOID OF DC CONNECTION AND SEMICONDUCTOR DEVICE IN SUBSTRATE

BACKGROUND OF THE INVENTION

This invention relates, in general, to a semiconductor component, and more particularly, to a monolithic circuit element.

Monolithic circuit elements such as, for example, resonators, microstrips, and transmission lines exhibit poor or low "Q" due to small element sizes and high conductor metal losses during millimeter-wave or other high frequency operation. As known in the art, a high "Q" is desired for efficient high frequency performance wherein the parameter "Q" is defined as a ratio between the resistance and the impedance of the monolithic circuit element. As the operating frequency of the monolithic circuit element is increased, a substrate on which the monolithic circuit element is mounted should be thinned in order to prevent the generation of higher order modes because the higher order modes degrade the performance of the monolithic circuit element. However, when the substrate is thinned, the current density in the monolithic circuit element is increased, which also degrades the high frequency performance of the monolithic circuit element. The width of the monolithic circuit element can be increased in order to reduce the current density in the monolithic circuit element, but then, other high frequency problems such as moding arise as a result of the increased width.

Accordingly, a need exists for a monolithic circuit element that exhibits a high "Q" factor and low loss during high frequency operation. The monolithic circuit element should be manufacturable and should also have a wide coupling range.

DETAILED DESCRIPTION OF THE DRAWINGS

Figure 1:
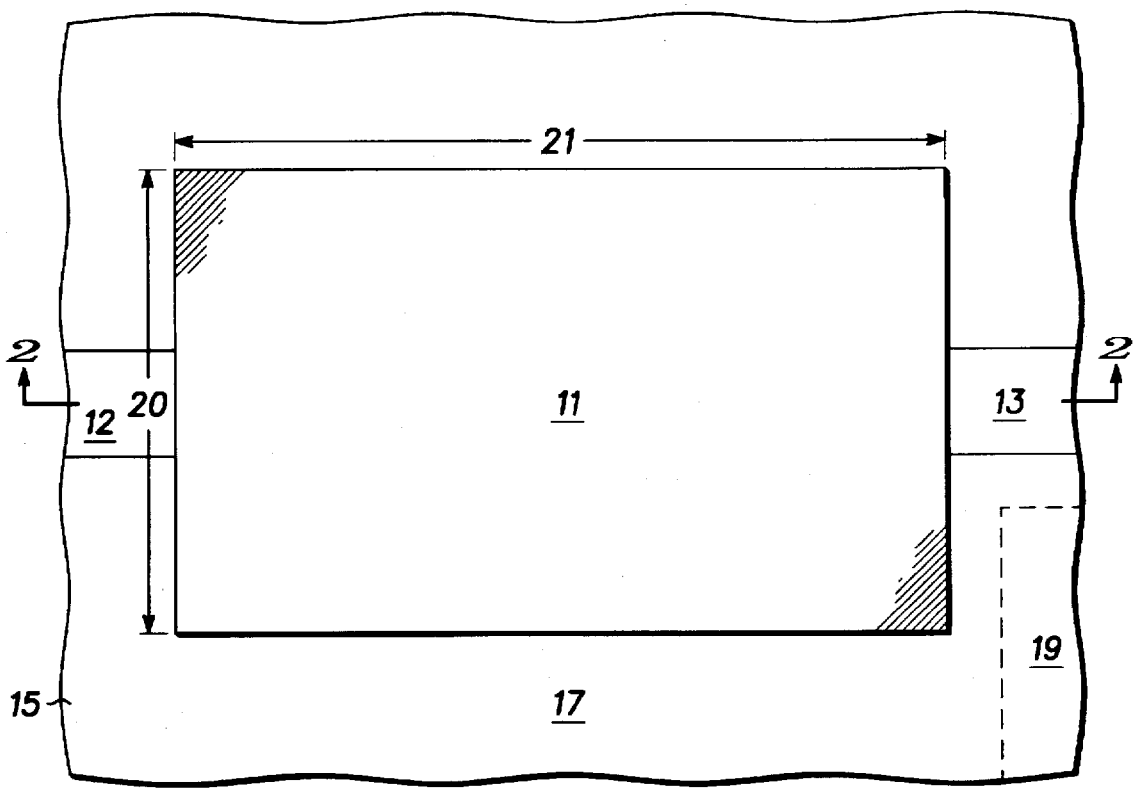
FIG. 1 illustrates a partial top view of an embodiment of a semiconductor component in accordance with the present invention.
Figure 2:
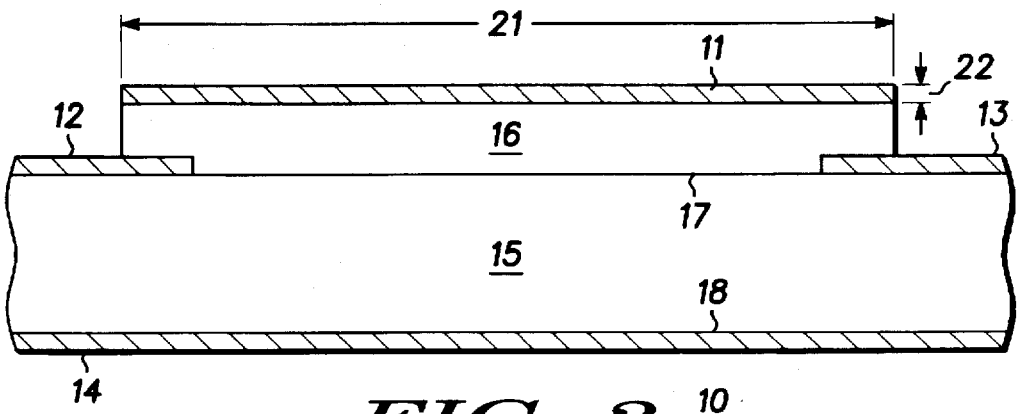
FIG. 2 portrays a cross-sectional view of the semiconductor component of FIG. 1 taken along a section line 2—2.

FIG. 1 illustrates a partial top view of an embodiment of a semiconductor component 10, and FIG. 2 portrays a cross-sectional view of component 10 taken along a section line 2—2 of FIG. 1. It is understood that the same reference numerals are used in the figures to denote the same elements. From the following discussion of component 10, one skilled in the art will understand that component 10 can serve as a resonator. Component 10 includes a substrate 15, electrically conductive layers 11, 12, 13, and 14, and an insulative layer 16. Substrate 15 supports layers 11, 12, 13, 14, and 16. Substrate 15 has a top surface 17 and a bottom surface 18 (FIG. 2), which is opposite surface 17. Substrate 15 can be comprised of a semiconductor material such as, for example, silicon or gallium arsenide, and substrate 15 has a dielectric constant, which is described in more detail hereinafter.

An optional semiconductor device or circuit 19 can be formed in substrate 15 using semiconductor processing techniques known to those skilled in the art when substrate 15 is comprised of a semiconductor material. Because circuit 19 can have many different structures, the depicted structure is only for the purpose of illustrating circuit 19. Circuit 19 can alternatively be located in a different substrate.

Electrically conductive layers 12 and 13 overlie or are adjacent to different portions of surface 17 of substrate 15. Depending upon the application for component 10, only one of layers 12 or 13 may be required in component 10. Layers 12 and 13 conduct a direct current (d.c.) electrical signal generated by an active device or circuit. For example, layer 13 can be electrically coupled to circuit 19. Distal ends of layers 12 and 13 point toward each other, and layers 12 and 13 are preferably coplanar for reasons explained hereinafter. Layers 12 and 13 are comprised of a material that is electrically conductive such as a metal including, but not limited to, gold, aluminum, copper, tungsten, or titanium. Layers 12 and 13 can be disposed over surface 17 using plating, evaporating, sputtering, or other deposition techniques known in the art.

Insulative layer 16 (FIG. 2) overlays or is adjacent to another portion of surface 17 of substrate 15, and the distal ends of layers 12 and 13 underlie different portions of layer 16. Layer 16 is formed between the distal ends of layers 12 and 13 and provides d.c. isolation between layers 12 and 13. Layer 16 can be comprised of a polyimide material, as known in the art. Furthermore, layer 16 has a thickness that is a substantial portion of a combined thickness of layer 16 and substrate 15 for reasons explained hereinafter. As an example, when substrate 15 is comprised of gallium arsenide and wherein layer 16 is comprised of a polyimide material, substrate 15 can have a thickness of greater than approximately forty microns and layer 16 can have a thickness of greater than approximately ten or twenty microns. Layer 16 also has a dielectric constant that is lower than the dielectric constant of substrate 15 for reasons explained hereinafter. As an example, when substrate 15 is comprised of gallium arsenide and when layer 16 is comprised of a polyimide material, substrate 15 can have a dielectric constant of approximately 12.9, and layer 16 can have a dielectric constant of approximately 3. Layer 16 can alternatively be comprised of other insulating materials including, but not limited to, silicon nitride or silicon oxide, but a polyimide material is preferably used for layer 16 because a polyimide material can have a lower dielectric constant than silicon nitride or silicon oxide. Furthermore, a polyimide material is also preferred because it is easier to provide an appropriate thickness for layer 16 when layer 16 is comprised of a polyimide material compared to when layer 16 is comprised of silicon nitride or silicon dioxide.

Electrically conductive layer 11 overlies or is adjacent to a portion of layer 16. Layer 11 is referred to in the art as a resonating layer because layer 11 assists in generating and is capable of conducting a resonating high frequency electrical signal. Layer 11 overlies at least a portion of the portion of surface 17 that underlies layer 16. Layer 11 is typically wider than either of layers 12 or 13 to facilitate the generation of a resonating signal. Portions of the distal ends of layers 12 and 13 underlie opposite distal ends of layer 11. Layer 11 is devoid of a d.c. electrical connection to layers 12 and 13. Accordingly, layer 16 is preferably continuous and preferably does not have any vias or holes over layers 12 or 13. However, layer 11 has a high frequency electrical coupling or connection to layers 12 and 13 through layer 16. The high frequency electrical coupling between layer 11 and layer 13 is provided by overlapping a distal end of layer 11 and a distal end of layer 13. Similarly, the high frequency electrical coupling between layer 11 and layer 12 is provided by overlapping a different distal end of layer 11 and a distal end of layer 12. Therefore, layers 11 and 12 and layers 11 and 13 form two capacitors wherein layer 16 serves as the insulative layer between opposite capacitive plates. For optimum electrical performance of component 10, the amounts of overlap between layers 11 and 12 and layers 11 and 13 are preferably approximately equal to each other, and the thickness of layer 16 over layers 12 and 13 is also preferably similar. To improve the high frequency electrical coupling between layers 11, 12, and 13, layer 11 is preferably approximately parallel to surface 17, and layers 12 and 13 are preferably substantially parallel to layer 11. Layer 16 should not be too thick to prevent or block the high frequency electrical coupling between layer 11 and layers 12 and 13.

Layer 11 can be comprised of similar materials as layers 12 and 13, and layer 11 can be provided over surface 17 using similar deposition techniques as previously described for layers 12 and 13. Layer 11 has a width 20, a length 21, and a thickness 22 wherein length 21 is greater than width 20 to facilitate end-coupling of layer 11. As illustrated in FIGS. 1 and 2, layer 11 is an end-coupled component because layer 11 is electrically coupled to electrically conductive layers 12 and 13 along opposite ends of the shorter sides, or width 20, of layer 11 and because layer 11 overlies the distal ends of layer 12 and 13. For proper resonating action, length 21 of layer 11 should be approximately half of a wavelength of the operating frequency of the electrical signal carried by or conducted from layers 12 or 13 into layer 11. As an example, when component 10 is operated at approximately 25–50 gigahertz and when thickness 22 of layer 11 is approximately 1–5 microns, width 20 and length 21 can be approximately 200–600 microns and approximately 900–1,300 microns, respectively. As known in the art, length 21 can alternatively be approximately a quarter of a wavelength of the operating frequency of the electrical signal carried by or conducted from layers 12 or 13 into layer 11.

Electrically conductive layer 14 (FIG. 2) is adjacent to surface 18 of substrate 15 and underlies layers 11, 12, and 13. Layer 14 serves as a ground plane for component 10. Layer 14 can be comprised of similar materials as layers 12 and 13, and layer 14 can be provided using similar techniques as previously described for layers 12 and 13. Layer 14 can be approximately parallel to layer 11 and to surface 17 of substrate 15.

In component 10, width 20 of layer 11 can be made wide enough to lower the impedance of layer 11 and to increase the "Q" factor of component 10 when layer 16 is a low loss material or has a lower dielectric constant than substrate 15 and when the thickness of layer 16 is a substantial portion of the combined heights of layer 16 and substrate 15. Layer 16, which has a lower dielectric constant than substrate 15, enables a reduction of the overall dielectric constant between layers 11 and 14, which increases the "Q" factor of component 10. Computer simulations of component 10 during millimeter-wave operation have shown an improvement in "Q" of more than a factor of two over resonators in the prior art in which a resonating layer is disposed directly on a substrate without an insulative layer such as, for example, layer 16 located between the resonating layer and the substrate.

Figure 3:
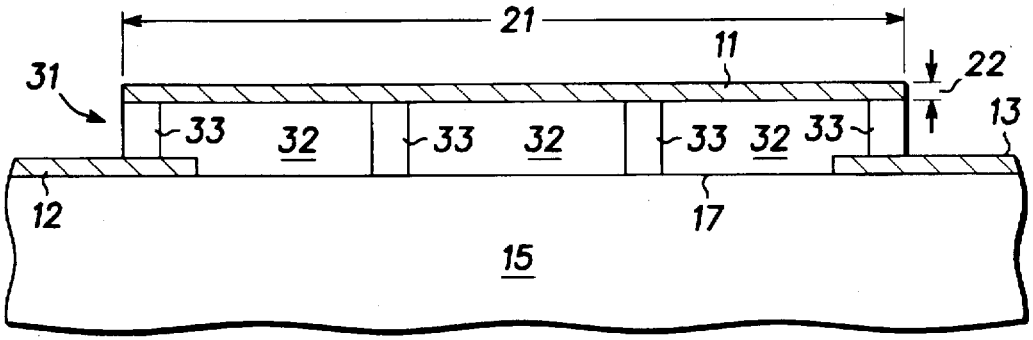
FIG. 3 represents a cross-sectional view of an alternative embodiment of the semiconductor component in FIG. 2 in accordance with the present invention.

FIG. 3 represents a cross-sectional view of a semiconductor component 30, which is an alternative embodiment of component 10 in FIG. 2. It is understood that the same reference numerals are used in the figures to denote the same elements. Component 30 has an insulative layer 31, which is used in place of layer 16 of component 10. Layer 31 is comprised of air 32 and a plurality of posts 33 wherein air 32 is located between posts 33. Both air 32 and posts 33 are preferably insulative materials that do not conduct a d.c. electrical signal. However, posts 33 can alternatively be comprised of an electrically conductive material, in which case posts 33 should not directly contact layers 12 or 13. Layer 31 can be formed, for example, by depositing a polyimide layer, forming holes, vias, or trenches in the polyimide layer, and depositing photoresist in the holes, vias, or trenches to form a substantially planar surface comprised of the polyimide layer and the photoresist. After forming layer 11 over the substantially planar surface, the photoresist is removed using conventional stripping and rinsing processes known to those skilled in the art. Thus, posts 33 support layer 11 over surface 17 of substrate 15, and posts 33 and air 32 remain beneath layer 11, as portrayed in FIG. 3. The thickness of layer 31 can be less than the thickness of layer 16 in component 10 because air 32 of layer 31 has a lower dielectric constant than the polyimide of layer 16. As an example, when layer 31 is comprised of air and a polyimide material and when substrate 15 is comprised of gallium arsenide and has a thickness of greater than approximately forty microns, layer 31 can have a thickness of greater than approximately five to ten microns. In the prior art, air bridges are used to suspend an inductor over a substrate to increase a bandwidth for the inductor, but the prior art air bridges are not used to increase the "Q" factor of the inductor because the prior art air bridges are less than three microns in height. Therefore, the prior art air bridges are too short and are not a substantial portion of a combined height of the substrate and the air bridge to significantly increase the "Q" factor for the inductor.

Figure 4:
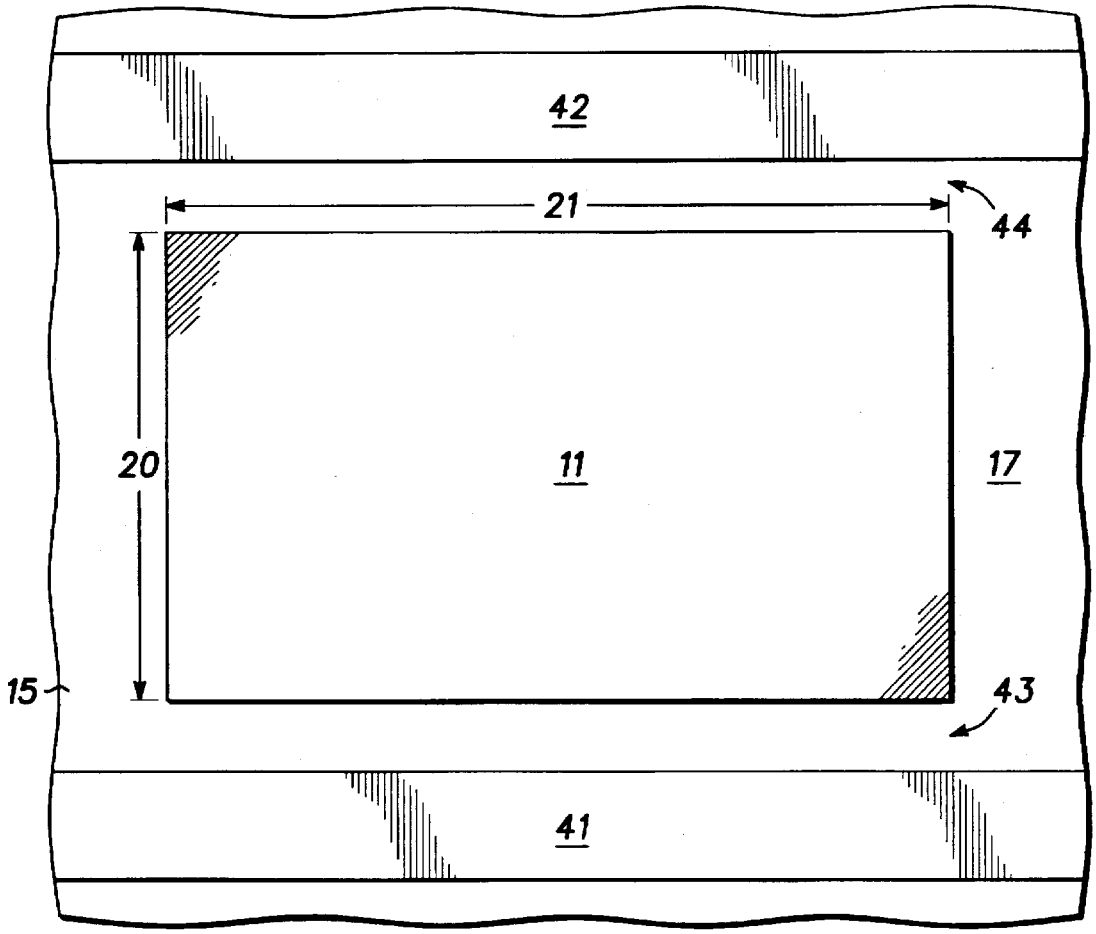
FIG. 4 depicts a top view of another alternative embodiment of the semiconductor component in FIG. 1 in accordance with the present invention.

FIG. 4 depicts a top view of a semiconductor component 40, which is another alternative embodiment of component 10 in FIG. 1. It is understood that the same reference numerals are used in the figures to denote the same elements. Component 40 has electrically conductive layers 41 and 42, which are supported by substrate 15 and which are used in place of layers 12 and 13 of component 10. In yet another alternative embodiment, layers 41 and 42 are supported by different substrates. An insulative layer such as, for example, layer 16 (FIG. 1) or layer 31 (FIG. 2) is located between layer 11 and substrate 15. Layer 11 is devoid of a d.c. electrical connection to layers 41 and 42, but layer 11 has a high frequency electrical coupling or connection to layers 41 and 42 across gaps 43 and 44, respectively. Gaps 43 and 44 should be less than approximately one micron in width. Layer 11 is an edge-coupled or side-coupled component because layer 11 is electrically coupled to layers 41 and 42 along opposite ends of the longer sides, or length 21, of layer 11. The end-coupling of component 10 (FIG. 1) is preferred over the edge-coupling of component 40 because the small size of gaps 43 and 44 must be tightly controlled and because gaps 43 and 44 are more difficult to repeatably manufacture compared to the thickness of layer 16 (FIG. 1). Therefore, component 10 of FIG. 1 is more manufacturable and has a wider coupling range than component 40. Furthermore, the end-coupling of component 10 provides a smaller size or footprint for component 10 compared to component 40.

Therefore, it is apparent there has been provided an improved resonator that overcomes the disadvantages of the prior art. The component or resonator has a high "Q" factor and also has low loss during high frequency operation. The resonator is manufacturable and has a wide coupling range and a small size.

While the invention has been particularly shown and described with reference to preferred embodiments, it will be understood by those skilled in the art that changes in form and detail may be made without departing from the spirit and scope of the invention. For instance, the numerous details set forth herein, such as, for example, the material compositions and the specific dimensions, are provided to facilitate the understanding of the present invention and are not provided to limit the scope of the invention. Furthermore, one skilled in the art will also understand that component 10 can be a portion of an electronic filter, an electronic oscillator, or other similar devices. Moreover, the use of a layer having a low dielectric constant to increase a "Q" parameter can also be applied to microstrips, transmission lines, or other similar devices. Accordingly, the disclosure of the present invention is not intended to be limiting. Instead, the disclosure of the present invention is intended to be illustrative of the scope of the invention, which is set forth in the following claims.

I claim:

1. A semiconductor component comprising:

a semiconductor substrate having a first surface and a second surface opposite the first surface;

a semiconductor device in the semiconductor substrate;

a first metal layer electrically coupled to the semiconductor device, the first metal layer adjacent to a first portion of the first surface, the first metal layer having a distal end;

a second metal layer adjacent to a second portion of the first surface, the second metal layer having a distal end;

a polyimide layer adjacent to a third portion of the first surface, the polyimide layer overlying the distal ends of the first and second metal layers;

a third metal layer overlying a portion of the polyimide layer and a portion of the third portion of the first surface, the third metal layer overlying portions of the distal ends of the first and second metal layers, the third metal layer devoid of a d.c. connection to the first and second metal layers; and a fourth metal layer adjacent to the second surface, the fourth metal layer underlying the third metal layer.

2. The semiconductor component of claim 1 wherein the polyimide layer has a thickness of greater than approximately ten microns and wherein portions of the polyimide layer that overlie the distal ends of the first and second metal layers are devoid of a via.

3. The semiconductor component of claim 1 wherein the first and second metal layers are substantially coplanar.

4. The semiconductor component of claim 1 wherein the first and second metal layers are substantially parallel to the third metal layer.

5. The semiconductor component of claim 4 wherein the third metal layer is substantially parallel to the first surface.

6. The semiconductor component of claim 1 wherein the third metal layer is substantially parallel to the fourth metal layer.

7. The semiconductor component of claim 1 wherein the first metal layer is devoid of a d.c. connection with the second metal layer.

8. The semiconductor component of claim 7 wherein the first and third metal layers have a first high frequency electrical connection with each other and wherein the second and third metal layers have a second high frequency electrical connection with each other.

9. The semiconductor component of claim 8 wherein the first and second high frequency electrical connections conduct the same high frequency signal.

10. The semiconductor component of claim 9 further comprising a layer of air between the third metal layer and the first surface of the semiconductor substrate.

* * * * *

UNITED STATES PATENT AND TRADEMARK OFFICE

CERTIFICATE OF CORRECTION

PATENT NO. : 5,751,201
DATED : May 12, 1998
INVENTOR(S) : Anthony M. Pavio

It is certified that error appears in the above-identified patent and that said Letters Patent is hereby corrected as shown below:

Title page, item [56], after Foreign Patent Documents, insert the following:

OTHER DOCUMENTS

| | | |
|---|---|---|
| | | Patent Abstracts of Japan, Vol. 18, No. 148 (E-1522), 11 March 1994 & JP 05 327311 A |
| | | (TDK CORP.), 10 December 1993. |
| | | Patent Abtracts of Japan, Vol. 12, No. 385 (E-668), 14 October 1988 & JP 63 128801 A |
| | | (MATSUSHITA ELECTRIC IND. CO. LTD.), 1 June 1988. |
| | | Patent Abtracts of Japan, Vol. 17, No. 559 (E-1445), 7 October 1993 & JP 05 160606 A |
| | | (SHARP CORP.), 25 June 1993. |
| | | Lin J. et al., "Active Integrated Antennas", IEEE Transactions on Microwave Theory and |
| | | Techniques, Vol. 42, No. 12, Part 01, 1December 1994, pages 2186-2194. |
| | | |
| | | |

Signed and Sealed this

Ninth Day of February, 1999

*Attest:*

*Acting Commissioner of Patents and Trademarks*

*Attesting Officer*